261-77
2/11/86 OF 4,569,804

United States Patent [19]

Murphy

[11] Patent Number: 4,569,804

[45] Date of Patent: Feb. 11, 1986

[54] LARGE BUBBLE FLOW GENERATOR-INTERFACE FOR LIQUID CIRCULATING DEVICE

[75] Inventor: Declan S. Murphy, Valois, Canada

[73] Assignee: Atara Corporation, Ville St. Laurent, Canada

[21] Appl. No.: 701,191

[22] Filed: Feb. 13, 1985

[51] Int. Cl.[4] ..... B01F 3/04

[52] U.S. Cl. ..... 261/77; 210/221.2; 261/123

[58] Field of Search ..... 261/77, 123; 209/170; 210/221.2; 435/313, 314

[56] References Cited

U.S. PATENT DOCUMENTS

| | | | |
|---|---|---|---|
| 1,574,783 | 3/1926 | Beth | 261/77 X |
| 2,717,774 | 9/1955 | Obma | 261/77 X |
| 3,246,761 | 4/1966 | Bryan et al. | 261/77 X |
| 3,592,450 | 7/1971 | Rippon | 261/123 |
| 3,628,775 | 12/1971 | McConnell et al. | 261/77 |
| 4,169,873 | 10/1979 | Lipert | 261/77 X |
| 4,187,263 | 2/1980 | Lipert | 261/123 X |
| 4,293,506 | 10/1981 | Lipert | 261/77 |
| 4,337,152 | 6/1982 | Lynch | 261/77 X |
| 4,356,131 | 10/1982 | Lipert | 261/123 X |
| 4,439,316 | 3/1984 | Kozima et al. | 261/77 X |

*Primary Examiner*—Richard L. Chiesa
*Attorney, Agent, or Firm*—McAulay, Fields, Fisher, Goldstein & Nissen

[57] ABSTRACT

An improved apparatus is provided for creating circulation and heat transfer capability within a large body of fluid. The apparatus comprises a vertically extending stackpipe, and large bubble generator means for generating an upward current flow through the stackpipe. Improved efficiency in generating liquid flow is obtained by providing an inclined guide surface to gradually introduce a large bubble from the generator into the stackpipe through a lateral opening into the stackpipe. Most preferably, the cross-sectional area of the stackpipe is expanded beginning at about the level at which the bubble enters the stackpipe and extending to a level at or above the top of the lateral opening into the stackpipe. In this way, interference with the flow of liquid in the stackpipe is minimized and the efficiency of flow generation is maximized.

18 Claims, 11 Drawing Figures

LARGE BUBBLE FLOW GENERATOR-INTERFACE FOR LIQUID CIRCULATING DEVICE

The present invention relates generally to improvements in liquid circulating devices for large standing bodies of liquid, and is more particularly related to more efficient flow generation by gas entrainment-type large bubble flow generators.

There are many procedures that require the maintenance of circulating flow in large, standing bodies of liquid, sometimes with concurrent heating or cooling to control the temperature of such bodies of liquids. The presence of a solid phase within the liquid generally necessitates a continuing agitation of the liquid in order to more uniformly suspend the solid within the body of liquid, and simultaneously to maintain a substantially uniform optimum temperature throughout the liquid. Such requirements are often met in anaerobic digestion systems, mining slurries, fermentation systems and the like.

The nature of the solids often encountered in such systems, make it desirable that moving mechanical parts be minimized in direct contact with the body of liquid or the solids dispersed therein. Similarly, it is important that the conduits through which the liquid is caused to flow be sufficiently large as to decrease the likelihood of blockage or interference with the desired flow. Reliability, ease of servicing and maintenance, and the avoidance of any interference with the biological, metallurgical or chemical process being carried on in the liquid are of paramount importance.

Large bubble generators have often been used for the above purposes, as is shown, for example, in U.S. Pat. Nos. 3,592,450 to Rippon, 3,628,775 to McConnell, and 3,246,761 to Bryan et al. Many of these devices include gas bubble generators comprising a gas accumulator tank and an inverted siphon connecting the accumulator tank to a vertically rising stackpipe. See also U.S. Pat. Nos. 4,169,873, 4,187,263 and 4,293,506, all to Lipert. A compound system, combining a large bubble generator in a lower portion and an aerator in an expanded funnel-shaped upper portion, with a central cylinder, has also been described in commonly assigned U.S. Pat. No. 3,628,775. Similarly, a compound stackpipe or flue, comprising an ascending series of stacked funnels, in which the narrow, upper end of the lower funnel feeds into the lower, wider end of the next higher funnel, is described in U.S. Pat. No. 4,138,335.

Although these large bubble generators have generally been considered to be more efficient than mechanical mixers for large standing bodies of a liquid-solid suspension, a previously unsuspected and surprising pressure loss has now been found during operation of such a system which reduces the energy efficiency of the system below its optimum value. Means for reducing or eliminating this pressure loss will thus result in a more energy-efficient system.

This unexpected pressure loss has been discovered to occur at or near the point along the stack at which the large bubble is injected from the generator, and apparently is at least partially created by the relatively abrupt manner by which the bubble is injected into the stackpipe flow.

It has now been found that the unexpected pressure loss inefficiency can be reduced or eliminated by providing an interface between the bubble generator and stackpipe that permits the acceleration of the bubble generated to provide an upward velocity component along the vertical direction of the stackpipe before the bubble enters the stream in the stackpipe; furthermore, the efficiency is further enhanced by also providing a cross-sectional discontinuity in the stackpipe adjacent the bubble entry location, such that the cross-sectional area of the stackpipe is increased from, and then decreased back to, its nominal cross-sectional area, beginning at a level substantially at, and ending downstream from, and above, the bubble entry level.

In accordance with the present invention, further improvement in a liquid circulation system, of the large gas bubble entrainment-type, is provided; the system comprises a substantially vertically extending, open-ended conduit stackpipe having an upper discharge opening, and designed to be submerged within the fluid; a large-bubble flow-generating means, located adjacent the stack, and an interface section placing the gas generator means in fluid flow connection with the interior of the stackpipe to entrain lifting and aerating gas into the liquid. In accordance with the improvement of this invention, the interface portion between the gas generator and the stackpipe comprises a downwardly and outwardly extending inlet guide wall extending from the side of the stackpipe at an entry angle of at least about 25° and not greater than about 50° above the vertical, and defining with the outer circumferential surface of the stackpipe a downwardly facing opening designed to be juxtaposed with the outlet from the large-bubble generator so as to receive bubbles therefrom and to provide for the gradual introduction of large gas bubbles into the stackpipe and thus minimize disruption of flow through the stackpipe.

The invention further provides that a portion of the stackpipe have an increased cross-sectional area, most preferably by way of a discontinuity along a portion of the circumference of the stackpipe beginning substantially at the level of the interface inlet opening along a length of the stackpipe extending upwardly from the lower interface opening a distance of at least twice the nominal stackpipe diameter, so as to form a "bulge" or convex in the pipe, projecting outwardly beyond the nominal diameter of the stackpipe a maximum distance of at least about one-half the nominal diameter of the stackpipe and having a total volume along the convex length of at least about 30% greater than nominal volume of the stackpipe along a length equal to the bulge length. The upper portion of the protrusion or bulge should taper inwardly and upwardly down to the nominal diameter, the slope of the taper should not be greater than about 1.2 and preferably not greater than about 1.0.

It has been found that the convex in the stackpipe can be located circumferentially separated from the interface portion guidewall, at locations as shown by dashed lines in the plan view of FIG. 1*a*, hereto. Alternatively, the bulge can be incorporated with the interface portion in the guidewall, and be located longitudinally adjacent the guidewall as shown, for example, by FIGS. 2*a* and 3*a*, hereto.

The preferred dimensions and volume in each of the cases of FIG. 1*a* and FIGS. 2*a* and 3*a*, respectively, vary, and can be found, by experimental testing. For example, a bulge of the type shown in FIG. 1*a*, including a gradual curvature extending upwardly, first outwardly and then inwardly returning to the nominal diameter of the stackpipe should preferably begin at a location substantially at the level of the bottom edge of the opening in the side of the stack for bubble entry, and have a total volume including the bulge, i.e., greater than the nominal volume of the stackpipe along the full length of the bulge, of between 130% and 155% of the nominal volume of the stack along that same length. Further, the angle between the interface guidewall and the nominal stackpipe outer circumference (vertical) is preferably in the range of from about 30° to about 45°. The guidewall extends downwardly and outwardly from the top of the lateral opening through the stackpipe, wall, substantially to the level of the bottom of the lateral opening into the stackpipe. The lateral stackpipe opening preferably has a square area of at least 35% of the nominal cross sectional area (i.d.) of the stackpipe and the top of the lateral stackpipe opening shall preferably coincide with the interface of the angled guidewall and stackpipe wall.

The various features and advantages of the present invention will become more apprent from the accompanying drawings and the following verbal descriptions of preferred embodiments of the present invention. The descriptions and drawings, and the following examples are merely given to show preferred examples, and are not intended to be exclusive of the scope thereof. The drawings are in many cases representative rather than detailed, and where specific details are not shown, it is anticipated that means well known to the art can be used to obtain the desired function. The descriptions and drawings and the following examples, are given to show preferred examples of the present invention, and are not intended to be, as drawn, exclusive of the scope thereof.

Referring to the drawings:

FIG. 1 is a diagrammatic elevation sketch of one preferred example of a stackpipe in accordance with this invention;

FIG. 1*a* is a plan view looking downwardly on the stackpipe of FIG. 1;

FIG. 2 is a diagrammatic elevation sketch of a second preferred type of improved stackpipe in accordance with this invention;

FIG. 2*a* is a plan view looking downwardly on the stackpipe of FIG. 2;

FIG. 3 is a diagrammatic elevation sketch of a third preferred type of improved stackpipe in accordance with the invention;

FIG. 3*a* is a plan view looking downwardly on the stackpipe of FIG. 3;

FIG. 3*b* is a front elevation view of the stackpipe of FIG. 3;

FIG. 3*c* is a partial cutaway view of the stackpipe of FIG. 3;

Figure 1:
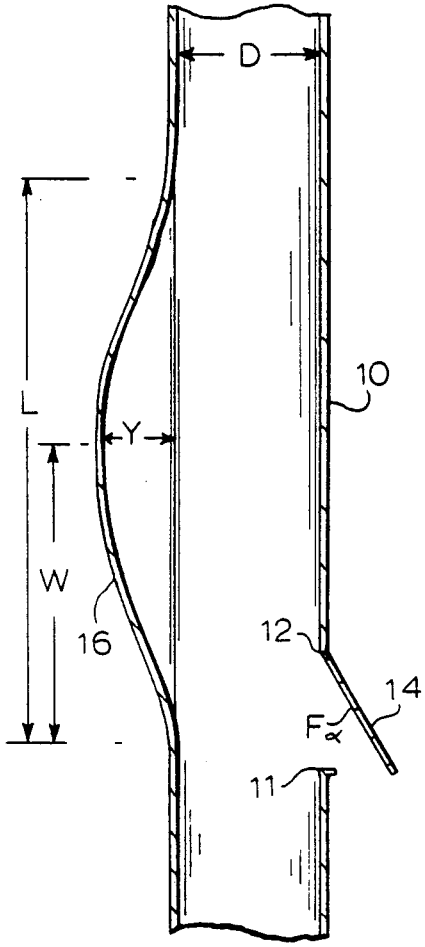

In the stackpipe of FIG. 1, the nominal outer wall of the stackpipe 10 has a side opening defined by a lower edge 11 and an upper edge 12 at a first longitudinal location along the stackpipe. A guidewall 14 extends downwardly and outwardly from the upper edge 12 at an angle of between about 30 and about 45 degrees up from the vertical (angle "$\alpha$"). Beginning at the same vertical level as edge 11, but circumferentially distant from edge 11, there is a discontinuity in the nominal outer wall 10 forming a bulge 16 in the stackpipe 10. The bulge 16 is formed by a gradual outward curvature of the stackpipe wall 10, in three dimensions, beginning at about the lower edge 11, so as to form a bulge extending beyond the nominal diameter of the stackpipe a distance, at its greatest extent, preferably not more than from about one-half the nominal diameter of the stackpipe ("D") to about three-quarters of the nominal diameter ("$Y=\frac{1}{2}D$ to $\frac{3}{4}D$"). The longitudinal level of the maximum outward bulge radius, Y, i.e., the greatest cross-sectional area, is located from about $\frac{3}{4}D$ to about $2\frac{1}{2}D$ above the level of edge 11 (a distance "Z") and the total length of the bulge ("L") is from about 2.5D to about 4D.

Referring to the diagrammatic representations of FIGS. 1, 2 and 3, the various relevant dimensions of the combination of this invention, exclusive of the large bubble generator, are defined as follows:

Nominal diameter of the stackpipe = D;

Maximum radius of the bulge 16 beyond the nominal circumference of the stackpipe = Y;

Total length of the bulge 16 = L;

Total volume of the bulge 16 = Z;

Distance between the lower edge of the side inlet opening and the maximum bulge level = W;

Angle between the interface guidewall 14 and the vertical = $\alpha$.

Figure 1A:
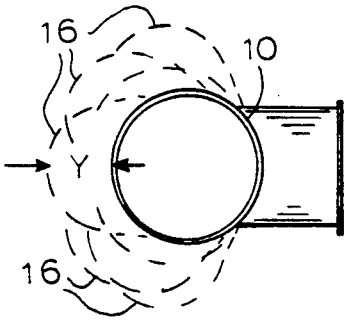

As shown by FIGS. 1 and 1*a*, the protrusion 16, which is located circumferentially separated from the interface guidewall 14 and large bubble inlet to the stackpipe, can be located at a variety of positions around the circumference of the stackpipe outside of the interface guidewall, or can extend around the entire circumference.

Figure 2A:
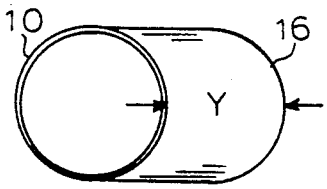
Figure 2:
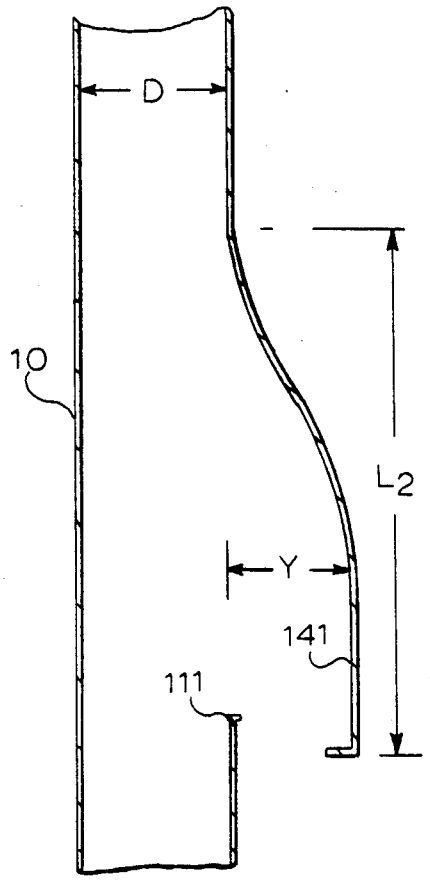
Figure 3:
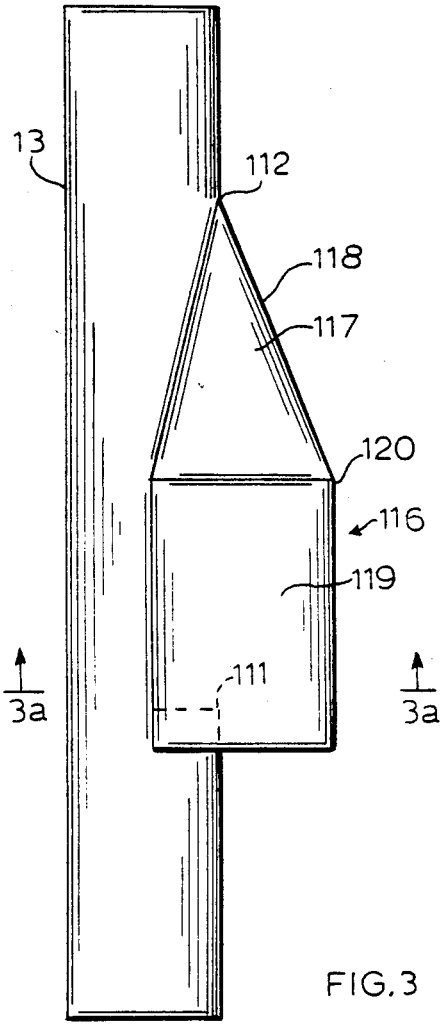
Figure 3A:
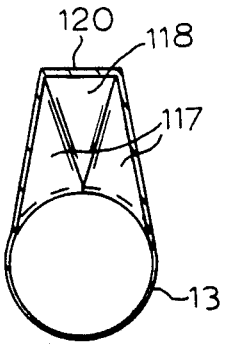

In the drawings of FIGS. 2 and 2*a*, as well as FIGS. 3 and 3*a, b, c*, the projection 141 and 116, respectively, is combined with and extends longitudinally from the interface guidewall. In this combined interface-local volume expansion embodiment of the drawings of FIGS. 2 and 3, the downwardly facing bubble entry opening into the interface, i.e., the guidewall 141, extends below the lower edge 111 of the lateral opening through the circumference of the stackpipe 10. The area of the bubble entry opening facing downwardly is equal to between about 25% and 55% of the nominal cross-sectional area of the stackpipe 10. The maximum radial extension of the bulge, i.e., from the lower edge 111 of the opening to the interface guidewall 141, is equal to from about $\frac{1}{2}D$ to about $\frac{3}{4}D$ (i.e., "Y"). For the continuous curve of FIG. 2, the vertical distance from the lower edge 111 of the lateral opening to the top of the projection, (i.e., "$L_2$") is preferably equal to a value of between about 2D and about 3D. In addition, it is preferred that the bottom of the interface guidewall 141 extends a distance of up to about $\frac{1}{8}D$ below the bottom edge 111 of the lateral opening. The volume of the expanded section along length $L_2$ is about 130% to about 155% of the nominal volume (i.e., $\pi(D/2)^2L_2$) of the stackpipe along that length.

Although a continuously curved surface for the projection is preferable, it is clearly less expensive and simpler to fabricate the combined projection and interface guidewall using sheet metal formed into planar sections as shown in FIGS. 3 and 3*a, b* and *c*.

Figure 3B:
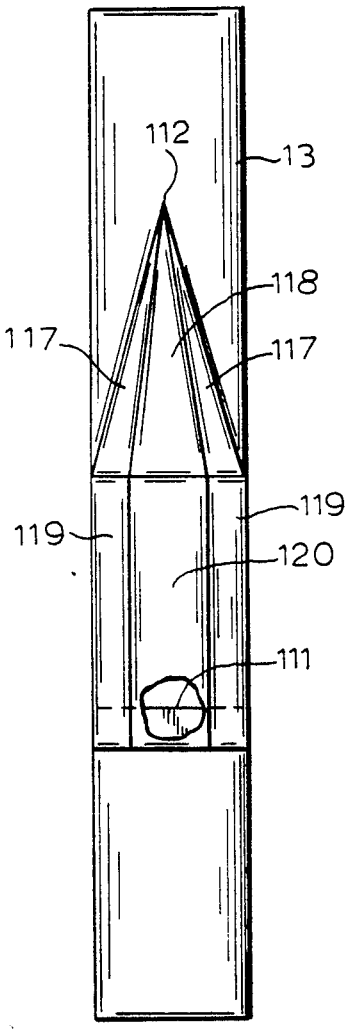
Figure 3C:
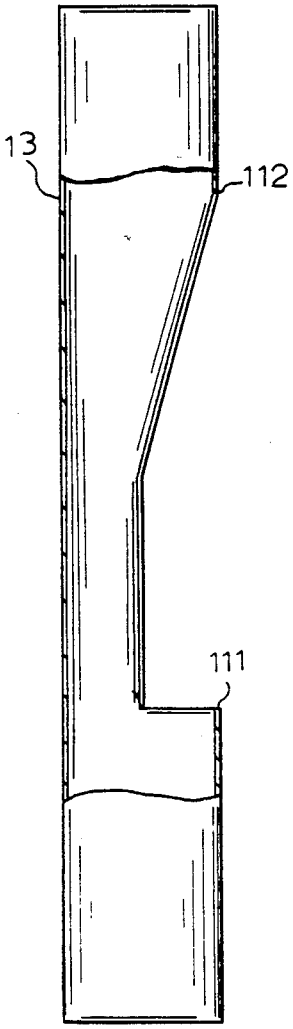

Referring to FIGS. 3 through 3*c*, the stackpipe (26 inches long) has a 180° cut-out from its circumferential wall extending straight upwardly longitudinally to level 120, about 1 to 2D higher. The cut-out edge then angles outwardly reducing the extent of the cut-out to zero at the upper point 112 1.5 to 2.5D higher. A trapezoidally-shaped box generally designated as 116, is then secured along and about the straight portion of the opening, and projecting outwardly beyond the nominal circumference of the stackpipe a distance of preferably from about ½D to D. The sheet metal side portions 119 extend downwardly below the lower edge 11 a distance of, preferably ⅛D to ½D. The stackpipe has a nominal internal diameter (D) and the outermost wall 120 of the trapezoidal cross-section of the guidewall, has a width preferably of from about ⅓D to about ⅔D. The combined volume of the box and stackpipe along the height of the lateral cut-out is preferably also in the range of about 130% to about 155% of the volume of the nominal stackpipe of the same height.

In normal operations, the stackpipe is designed to be fully submerged in a large body of liquid and preferably, other than the bulge adjacent the interface inlet portion, has a substantially constant cross-section along its entire length.

If pipes having non-circular cross-sections are used in the present invention, the "equivalent diameter", is a value equal to 4 times the hydraulic radius ($r_h$) of the pipe, and should be used in sizing the pipe for purposes of this invention.

To insure that the flow through these mixing means reaches the full depth of any tank or other container holding the fluid to be mixed, and in which the stackpipe mixer is immersed, the bottom of the stackpipe is preferably at least about one diameter (D) above the floor of the fluid, and most preferably not more than about 4D above the floor.

The liquid flow generating means is a gas entrainment means, which can be most suitably applied to the stackpipe, of the "large gas bubble type", such as that described in U.S. Pat. Nos. 4,293,506, and 4,187,263, both to Lipert. In general, these systems provide for the injection of a large bubble of gas, specifically one which ultimately extends across the full cross-section of the stackpipe, by a gas bubble generator. The gas bubble, as it moves upwardly through the stackpipe, acts, in effect, as a piston to move liquid upwardly before it.

Figure 4:
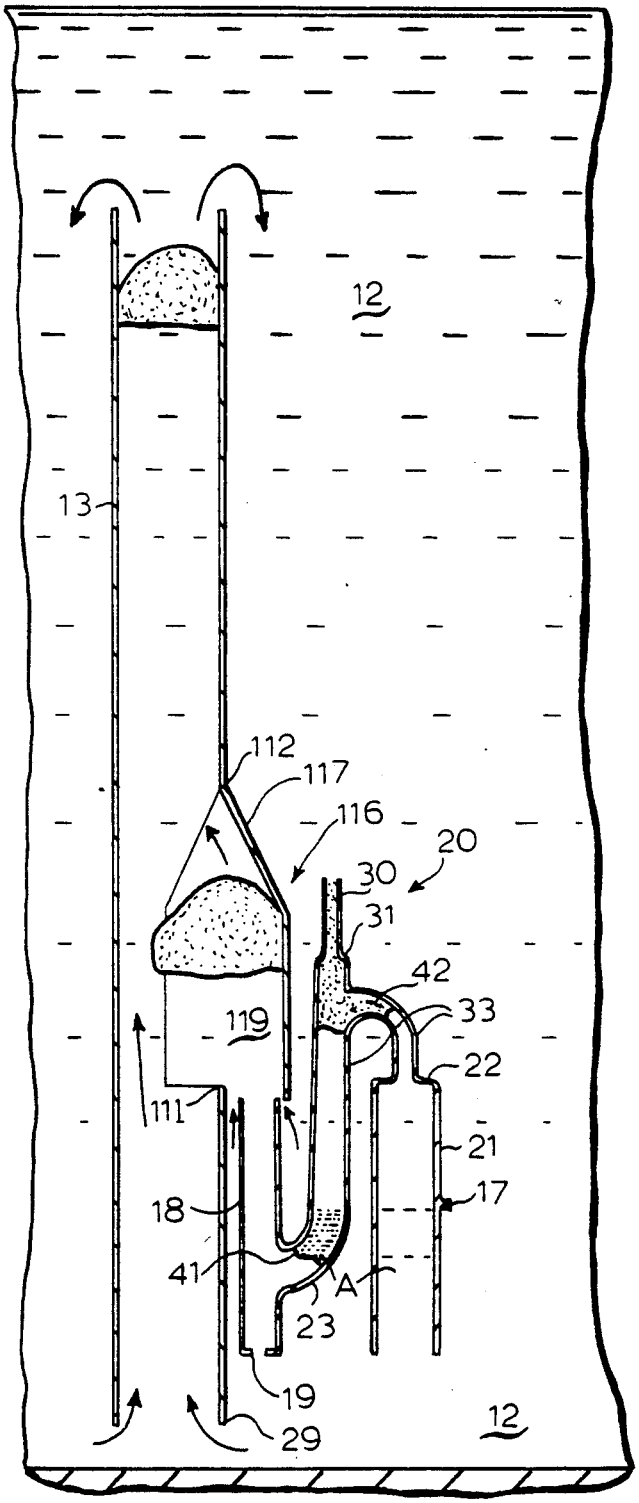
FIG. 4 is a side elevation view of a system in a sewage treatment tank including a stackpipe in accordance with FIG. 3 and a large bubble generator.

FIG. 4 shows one embodiment of the present invention, by way of example, completely submerged in a body of aqueous liquid 212, such as an anaerobic sewage digestion tank, or the like, and comprises an open-ended vertical stackpipe generally indicated by the numeral 13, supported within the body of liquid. The open lower end of the stackpipe 13 can either be supported on a separate stand extending upward from the floor beneath the body of liquid, or by other means not shown. The downwardly facing inlet to the interface section generally indicated as 116, is centered around a standpipe 18. The lower end of the standpipe 18 has a restricted orifice opening defined by lower plate 19.

Figure 5A:
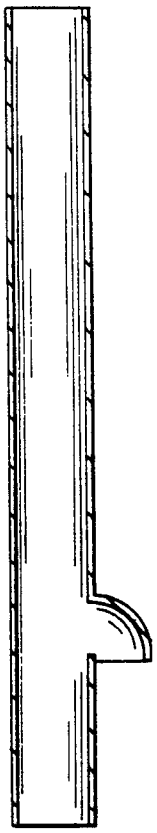
FIG. 5*a* is a comparative drawing of a prior art stackpipe.
Figure 5:
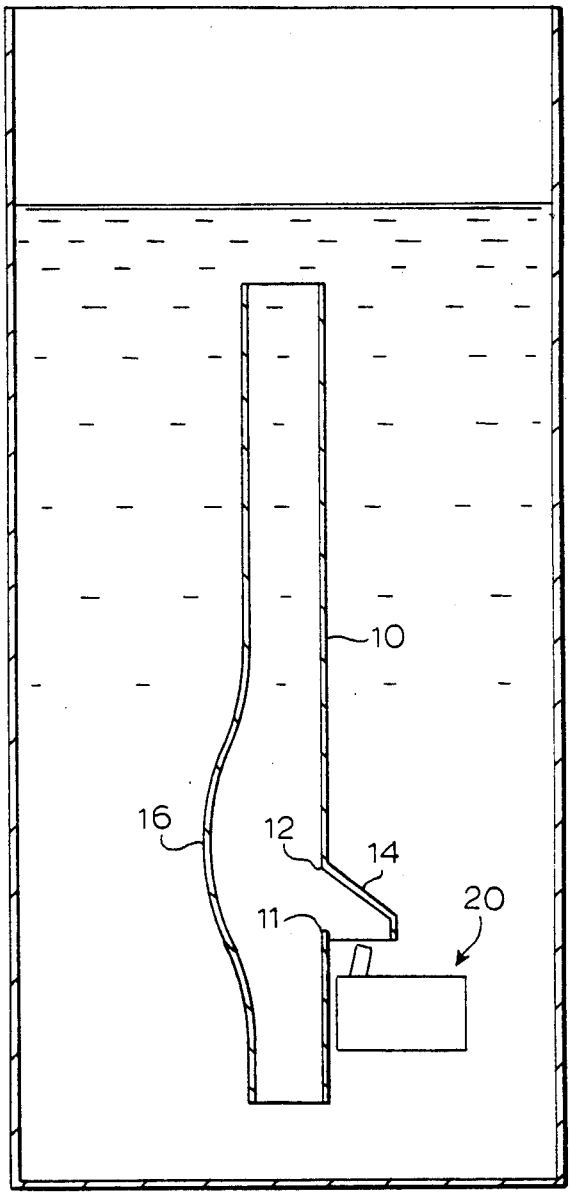
FIG. 5 PRIOR ART
FIG. 5 is a side elevation view of a test system including a stackpipe in accordance with the present invention.

The combined liquid flow generator and gas entrainment means, generally designated by the numeral 20 in FIG. 5, comprises a large-bubble generating means of the type described, for example, in U.S. Pat. No. 4,293,506. This particular large-bubble generator is disposed adjacent to the standpipe 18 within the standing body of liquid. The large bubble generator 20 comprises a circular cylindrical gas accumulator tank 17, connected through its peripheral wall via a curved siphon pipe 33 to the standpipe 18.

In the operation of the improved mixer of the present invention, the volume of gas under pressure accumulates in the accumulator tank 17 until a certain level is reached, at which point it is rapidly siphoned out through leg 33, into the standpipe 18 and enters as a single large bubble into the interface portion 119 and then accelerates upwardly and inwardly into the stackpipe 13. The volume of the bubble generator accumulator tank 17 is matched to the stackpipe diameter, such that the bubble generated has a volume of from about 30% to about 80% sphere volume. Liquids having densities substantially greater than water may require higher sphere volume percentages of the stackpipe 13 at the level of entry 111.

The large bubble rises upwardly through the standpipe 18 and into the interface section 116. The bubble expands as it rises through the interface section 116, and is guided towards the stackpipe 13 by guidewall 117. As the bubble rises through the interface section (moving within the bulge volume), it is accelerated until it acquires an upward acceleration about equal to the velocity of the flow of liquid in the stackpipe at that level and thus does not interfere with fluid flow when it reaches the end of the bulge 112 and fills the entire cross-section of the stackpipe 13 which is 25% to 55% smaller then the combined volume of the interface section 116 (bulge).

When the bubble reaches the level of the uppe edge 112 of the bulge area, and it fills the entire cross-sectional area of the stackpipe 13 as it continues to rise, it serves to raise all of the liquid within the pipe above the bubble, acting much as would a piston. As the large bubble pushes the water out of the top of the stackpipe 13 in front of it, additional liquid is brought into the stackpipe 13 through the bottom opening 29. As shown by the arrows in FIG. 4, a circulation through the standing body of liquid 212 is thus obtained. As the bubble moves upwardly through the stackpipe 13, the bubble generating cycle is repeated in the gas generator 20, thus producing subsequent bubbles and creating a continuous flow of fluid. The effectiveness of this invention is shown by increased liquid flow rate through stackpipe 13 for a given flow of air pumped to the bubble generator 20 as compared to a stackpipe that does not include the guidewall interface and bulge of the present invention.

The following examples further provide descriptions of preferred embodiments of the present invention and show the unexpected advantages of this invention.

EXAMPLES 1-3

In a large tank, having a total capacity of 175 U.S. gallons, a horizontal cross-section of 28 inches×28 inches and a liquid height of 50 inches (water, maintained at about 15° C.), a stackpipe 42 inches long, having an internal diameter of 4 inches is connected as shown in FIG. 5 to a large bubble generator 20: the stackpipe is of the type shown in detail in FIG. 1 and is supported approximately 4 inches above the floor of the tank, with the upper end approximately 4 inches below the top surface of the liquid. The guide wall 14, defining the downwardly facing inlet into the interface section, extended 3 inches out from the pipe and was 2.25 inches wide; the bottom of guidewall 14 was located 8¼ inches above the bottom of the stackpipe 13. The guidewall 14 is straight and extends at an angle, $\alpha=35°$ up from the stackpipe circumference. The bulge wall 16 extends along the stackpipe for 13 inches (L) and defines an additional volume beyond the nominal cross-section of the stackpipe of about 57 square inches and has a maximum radius of bulge (Y) of 2 inches.

Air is pumped to the large bubble generator so as to generate the air bubble into the stackpipe, in accordance with the air flow rate shown in the accompanying Table 1.

The flow rate of air to the large bubble generator was measured using a "DWYER" rotameter (0–1000 SCFH) and the pressure of the gas fed to the large bubble generator was determined by a dial pressure gauge, 0–50 psi., to determine volumetric gas flow as standard cubic feet per hour (SCFH). The velocity of liquid flow, i.e., water, through the stackpipe was measured utilizing a Marsh McBirney electromagnetic water current meter, the probe being centered in the flow, taking measurements in the eductor section at the bottom of the stackpipe 10.

A series of tests were run taking the data described above, for a range of indicated cubic feet per hour (ICFH) of gas flow first for the improved stackpipe of this invention (FIG. 5) (Examples 1, 2 and 3) and then for a conventional stackpipe, as shown in FIG. 5A (Examples A, B and C). The conventional stackpipe was identical to that of FIG. 5, except that there was no "bulge" in the stackpipe and that the bubble inlet was a conventional inlet of the same opening area as that of FIG. 5. The resultant water flow through the two stackpipes are compared in Table 2; the parameters necessary to generate the desired air flow rates are shown in Table 1.

TABLE 1

| ICFH (air) | PI (psi) | FREQ. (sec/bub.) | SCFM | CCFS | % SPH VOL* of bubble generated |
|---|---|---|---|---|---|
| 200 | 1.75 | 0.91 | 3.43 | 0.05 | 242.17 |
| 100 | 1.50 | 1.06 | 1.70 | 0.03 | 139.97 |
| 50 | 1.45 | 1.20 | 0.85 | 0.01 | 79.10 |
| 25 | 1.40 | 2.30 | 0.42 | 0.01 | 75.69 |

*SPH VOL = a volume of air in a sphere having a diameter = D, at the stackpipe inlet depth and liquid temperature.

TABLE 2

| Example No. | | ICFH | FPS (Average Ft/sec.) | FLOW (USGPM) |
|---|---|---|---|---|
| | 1 | 200.00 | 2.73 | 90.72 |
| | 2 | 100.00 | 2.05 | 68.25 |
| | 3 | 50.00 | 1.70 | 56.59 |
| Comparative | A | 200.00 | 2.35 | 78.23 |
| | B | 100.00 | 1.90 | 63.25 |
| | C | 50.00 | 1.55 | 51.60 |

NOTE:
Velocity correction factor of 0.85 used for flow correction

It is clear from a comparison of the results in Table 2 above that a substantial and unexpected improvement in total flow rate of liquid through the stackpipe is obtained, for a given air bubble flow, by the use of the improved stackpipe of the present invention. By obtaining a greater liquid flow utilizing the same air flow rate, greater mixing is obtained through the tank of liquid, for a given amount of power used in generating the air flow, than is possible using a constant diameter stackpipe with the old bellmouth type entry.

EXAMPLES 4–6

The same procedure set forth above for Examples 1–3 were repeated except that a combined inlet guide-bulge type of stackpipe in accordance with FIG. 3 was used, i.e., the bulge is combined with the bubble entry interface section having planar sides. The interface section and bulge were straight-sided, and formed as shown in FIGS. 3 through 3*c* by cutting away half of the circumference of the stackpipe beginning at a level (lower edge 111) 4 inches above the bottom and extending upwardly 6 inches to the next level 120, and then gradually reducing the extent of the cutaway from the second level 120 to the top level 112 (7 inches higher along the stackpipe). Interface side walls 119 are tangentially secured to the circumference of the stackpipe 13 at diametrically opposite sides of the stackpipe 13 and each extend outwardly 3 inches beyond the nominal circumference (a total of 5 inches long) and are connected along their outer edges by face plate 120, which is 2 inches wide (see FIGS. 3 and 3*a*). The top of the interface section is enclosed by three triangular sheets 117 and 118, two of which sheets 117 are connected to the slanting cutaway edge 118 of the stackpipe 13. The side plates 119 and face plate 120 extend one inch below the lower edge 111 of the cut-out portion of the stackpipe 13.

The results of the three tests using the FIG. 3 embodiment of this invention were within 0.5% of the results obtained for Examples 1 to 3, respectively.

The patentable embodiments of this invention which are claimed are as follows:

1. In apparatus for creating circulation within a body of liquid, the apparatus comprising a substantially linearly extending, open-ended stackpipe having a substantially constant nominal diameter ("D") and designed to be submerged in the liquid, the stackpipe having an upper discharge opening and a lower inlet opening and an intermediate lateral opening; flow generating means comprising a large bubble generator in fluid flow connection with the interior of the stackpipe through the lateral opening in the stackpipe; and means for delivering gas under pressure to the large bubble generator; the improvement comprising an interface section surrounding the lateral opening and comprising an outwardly and downwardly extending guide surface, extending downwardly and outwardly from the top of the lateral opening at an angle of from about 25° to about 50° up from the vertical, and wherein the cross-section of the stackpipe is expanded beginning at about the level of the bottom edge of the lateral opening and extending upwardly a distance of at least about twice the nominal diameter of the stackpipe.

2. The apparatus of claim 1 wherein the expansion of the cross-section of the pipe is provided by expanding outwardly beyond the nominal circumference of the stackpipe a longitudinal section of the stackpipe which is circumferentially separate from the guide surface.

3. The apparatus of claim 2 wherein the expansion of the cross-section of the stackpipe is integral with the stackpipe wall and is formed by a gradual curvature upwardly and radially outwardly beginning at about the bottom of the lateral opening to a maximum radial expansion and then gradually curving radially inwardly and upwardly back to the nominal diameter, forming a convex.

4. The apparatus of claim 3 wherein the total length of the expanded portion of the stackpipe is in the range of from about 2.5D to about 4D.

5. The apparatus of claim 1 wherein the length of the expanded portion of the stackpipe is at least about 2.5D but not greater than about 3.5D.

6. The apparatus of claim 1 wherein the expansion of the cross-section of the pipe is provided by projecting outwardly beyond the nominal cross-section of the stackpipe a longitudinal portion of the stackpipe which is longitudinally adjacent to and incorporated with the guide surface, the guide surface forming the upper portion of the projection.

7. The apparatus of claim 6 wherein the projection is formed integral with the stackpipe wall at the upper end of the lateral opening by a gradual curvature downwardly and radially outwardly to a maximum radial projection, and extends downwardly to at least the bottom of the lateral opening.

8. The apparatus of claim 7 wherein the vertical length of the lateral opening is not greater than about 3D.

9. The apparatus of claim 8 wherein the projection extends to a level not more than about ⅛D below the bottom of the lateral opening.

10. The apparatus of claim 7 wherein the guide surface forms the upper portion of the projection and tapers radially outwardly and downwardly at a slope of not greater than about 1.0.

11. The apparatus of claim 6 wherein the projection is formed of substantially planar wall elements, the uppermost element being connected to the stackpipe at the upper end of the lateral opening and extending downwardly and outwardly to the maximum radial projection and wherein the lowermost portion of the projection is a substantially planar, vertically extending member connected at its upper end to the lower edge of the uppermost element and extending downwardly to at least the bottom of the lateral opening, and the vertical length of the lateral opening is not greater than about 3.5D.

12. The apparatus of claim 11 wherein the projection extends to a level not more than about 0.5D below the bottom of the lateral opening.

13. The apparatus of claim 1 wherein the guide surface extends downwardly and outwardly at an angle of from about 30° to about 45° up from the vertical.

14. The apparatus of claim 1 wherein the total diameter of the expanded portion of the stackpipe at the level of maximum expansion is from about 1.5D to about 1.75D.

15. The apparatus of claim 1 wherein the total volume of the expanded portion of the stackpipe has a volume of at least about 130% the nominal volume of the stackpipe of the same vertical length as the expanded portion.

16. The apparatus of claim 15 wherein the total volume of the expanded portion is not greater than about 155% of the nominal volume of the stackpipe of the same length.

17. The apparatus of claim 1 wherein the expended portion of the stackpipe, at its upper end, tapers gradually down to the nominal diameter.

18. The apparatus of claim 17 wherein the slope of the taper is not greater than about 1.2.

* * * * *